United States Patent [19]

Suggitt et al.

[11] Patent Number: 4,919,688

[45] Date of Patent: Apr. 24, 1990

[54] GASIFIER WITH GAS SCROURED THROAT

[75] Inventors: Robert M. Suggitt, Wappingers Falls; Mitri S. Najjar, Hopewell Junction, both of N.Y.

[73] Assignee: Texaco Inc., White Plains, N.Y.

[21] Appl. No.: 147,090

[22] Filed: Jan. 20, 1988

Related U.S. Application Data

[63] Continuation of Ser. No. 914,847, Oct. 3, 1986, abandoned.

[51] Int. Cl.[5] ..... C10J 3/48; C10J 3/82

[52] U.S. Cl. ..... 48/69; 48/87; 48/DIG. 2

[58] Field of Search ..... 48/62 R, 63, 69, 77, 48/87, DIG. 2; 422/207; 261/112.1, 111, 115, DIG. 54; 55/223, 244, 256; 110/171; 122/390; 134/22.18, 37, 39; 196/122

[56] References Cited

U.S. PATENT DOCUMENTS

| | | | |
|---|---|---|---|
| 3,414,632 | 12/1968 | Buschmann et al. | 422/207 |
| 3,988,123 | 10/1976 | Coates | 48/77 |
| 4,220,469 | 9/1980 | Tippmer | 48/202 |
| 4,300,913 | 11/1981 | Egert et al. | 48/69 |
| 4,328,006 | 5/1982 | Muenger et al. | 48/62 R |
| 4,328,007 | 5/1982 | Rafail | 48/77 |
| 4,444,697 | 4/1984 | Gater et al. | 422/207 |
| 4,479,809 | 10/1984 | Johnson et al. | 48/77 |
| 4,525,176 | 6/1985 | Koog et al. | 48/DIG. 1 |
| 4,605,423 | 8/1986 | Koog | 48/69 |

*Primary Examiner*—Joye L. Woodard

*Attorney, Agent, or Firm*—Robert A. Kulason; James J. O'Loughlin; Robert B. Burns

[57] ABSTRACT

Gasifier for combusting a particulated carbonaceous fuel by injecting a stream of the fuel into the gasifier combustion chamber together with a combustion supporting gas. The fuel mixture is burned to produce a usable gas and a particulated residual, both of which are directed into a liquid holding quench chamber. A constricted, frusto-conical throat which conducts the usable gas and particulated residual includes one or more nozzles that open into the throat and serve to direct pressurized jets of a scouring fluid into contact with residual particles which have become deposited on the throat wall, to displace the latter and thereby keep the throat void of such deposits.

3 Claims, 4 Drawing Sheets

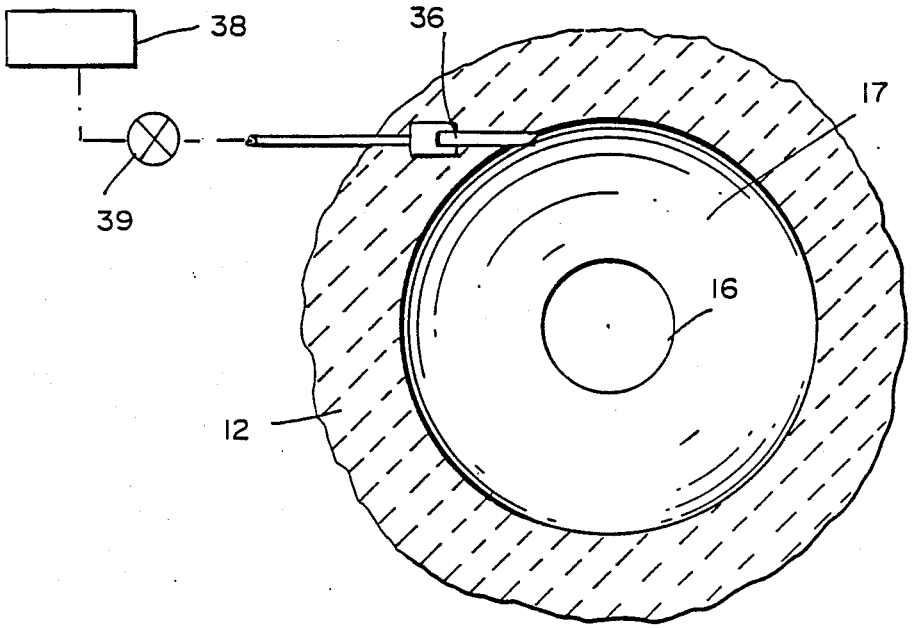
FIG. 5
FIG. 6
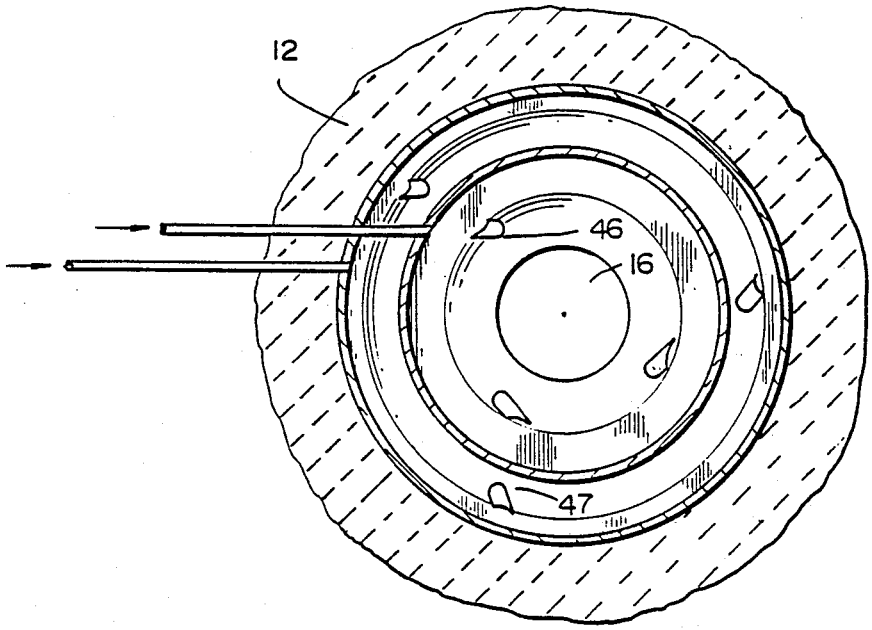

GASIFIER WITH GAS SCROURED THROAT

This is a continuation of application Ser. No. 914,847, filed Oct. 3, 1986, now abandoned.

BACKGROUND OF THE INVENTION

The gasification of solid carbonaceous materials such as coal and coke is well known in the art. From a broad consideration, a combustible mixture of the carbonaceous fuel, together with a combustion supporting gas, is burned to produce a usable synthetic gas as well as a residual ash or solid material.

In a typical prior art apparatus for achieving a gasification process, the gasifier or reactor vessel is normally comprised of a heavy steel shell. Since the gasification process is carried out at an elevated temperature within the range of 1800° to 3500° F., and pressure about 5-250 atmospheres, at least a portion of the shell is insulated with a refractory material along the shell's inner walls.

The shell is generally disposed in an upright position, defining at the upper end a combustion chamber within which the carbonaceous fuel mixture is burned.

A burner positioned in the gasifier wall is communicated with a source of the carbonaceous fuel preferably in slurry form. It is communicated as well as with a source of a pressurized combustion supporting gas such as oxygen or air. In the burner, the solid and gaseous components are directed under pressure, from the burner discharge port, into the reactor combustion chamber.

In said combustion chamber, complete or partial combustion of the fuel results in the production of the synthetic gas, together as noted, with a solid residue. The latter normally takes the form of an ash, or solid particles which are initially whirled violently about the combustion chamber.

The lower end of the combustion chamber terminates at the chamber floor. The latter includes an opening through which the produced gas and the solid residue are conducted into a liquid holding quench chamber.

FIG. 1, illustrates a segment of a gasifier structure utilized in the prior art. To facilitate handling of the hot produced gas and residue, the quench chamber is disposed in the lower part of the reactor shell. Said quench chamber includes a pool of liquid coolant, preferably water, together with a dip tube which functions to conduct and guide the gas and solid materials into the water bath. The gas then emerges from the bath in cooled form.

The quench chamber is further provided with one or more discharge conductors for the produced gas. The lower end of said chamber includes an outlet means for removing the cooled, solid component in the form of a slurry by way of a lockhopper or similar apparatus.

A number of carbonaceous fuels are considered appropriate to the gasification process. These include coal, both anthracite and bituminous, as well as lignite, coke and other carbonaceous materials. It can be appreciated that each form of fuel is characterized by a particular composition and consequently results in a different form of produced gas as well as residual.

After any run of the reactor during which the synthetic gas is produced, the residuals will normally be at a temperature which exceeds their melting points. They will consequently flow downwardly along the wall of the gasifier to the floor of the combustion chamber.

From the latter, these fluidized solid materials will continue downwardly through the connecting segment between the gasifier combustion chamber, and the quench chamber. Both solids and gas will then pass into and through the liquid bath.

When it becomes necessary to shut down or discontinue operation of a gasifier run, the inflow of fuel mixture from the burner is discontinued such that the combustion event ceases. As the unit progressively cools, at least some of the residual materials, remaining on the reactor walls, will freeze and solidify.

Thereafter, when the unit is again activated for a subsequent run, it will normally be preheated prior to introduction of the gas producing fuel mixture. Preheating is generally achieved through use of a special burner in which the combustible mixture is burned to bring the combustion chamber temperature to a working level. When said level is reached, the preheat burner will be replaced by a fuel feeding burner. Thus, the combustible carbonaceous fuel is introduced into the hot combustion chamber and ignited.

It has been experienced that during the required preheat period within a temperature range of about 1400° F. to 2200° F., which precedes reactor start-up, certain of the solid deposits from the previous run, and particularly those which are rich in vanadium, will tend to oxidize. This phenomena is noticeably true when the previous fuel was comprised primarily of a petroleum coke. The formation of pentavalent vanadium for example, will create a molten material that flows down the combustion chamber walls and into the constricted throat at the combustion chamber lower end.

Due to the low flow of gases through the constricted throat under preheating conditions, and further due to the loss of radiant energy in the quench zone below the throat, the latter will remain relatively cool. This condition persists even though the gasifier combustion chamber may achieve temperatures within the range of 2000° to 2200° F.

As a result, the liquefied or flowing, vanadium rich slag will tend to deposit and then solidify onto the colder wall portions of the throat. If this freezing action persists, the solid material will progressively accumulate, and thereby create at least a partial barrier to passage of produced gas and ash from the combustion chamber.

During a reactor start-up period, even though temperature in the reactor constricted throat may rise due to the much higher flow rate of the hot gases, the switch to a reducing atmosphere within the reactor effectuates a change in the chemical character of the vanadium rich deposits.

The melting point of the deposited metal thus rises beyond the temperature of the produced gas. As a result, the deposits will remain in solid form within the reactor throat in spite of temperatures well above 2000° F. This progressive development of a plugging or a blockage in the throat area creates excessive backpressures across the throat as the gas flow rate increases.

Toward overcoming this undesirable accumulation of material, or the forming of a barrier in the gasifier throat, which could eventually result in a complete or partial blockage, means is herein disclosed for gaseous flow to the throat area. The desired result is to maintain the throat and its adjacent radiant section clear of such deposits.

In a preferred embodiment, the gasifier throat, and its downstream radiant section are provided with at least one, and preferably with a plurality of high pressure fluid stream nozzles. The latter are positioned to open or discharge into the throat downstream, and are communicated either individually or through manifolding to a pressurized fluid source. The fluid, preferably hot gas, is formed as it leaves the fluid stream nozzles into high velocity streams, or a jet flow pattern suitable for dislodging solids from the throat and downstream walls.

The supplementary fluid is preferably a gas which is preheated. Further, the gas can be hot produced or synthetic gas which is recycled from the gas generator.

It is therefore an object of the invention to provide a gasifier for producing a synthetic gas wherein the gasifier throat is provided with means for maintaining the walls of the throat in a relatively free and uncluttered with solid matter.

A further object of the invention is to provide means in a gasifier unit for avoiding accumulation of solid residual particles in a gasifier's relatively constricted throat.

A still further objective is to maintain the efficiency of a gasifier unit from the point of view of producing a synthetic usable gas, by maintaining the gasifier throat in a relatively cleared condition.

DESCRIPTION OF THE DRAWINGS

FIG. 5 is a cross-sectional view taken along line 5—5 in FIG. 3.

FIG. 6 is a cross-sectional view taken along line 6—6 in FIG. 4.

DESCRIPTION OF A PREFERRED EMBODIMENT

Figure 1:
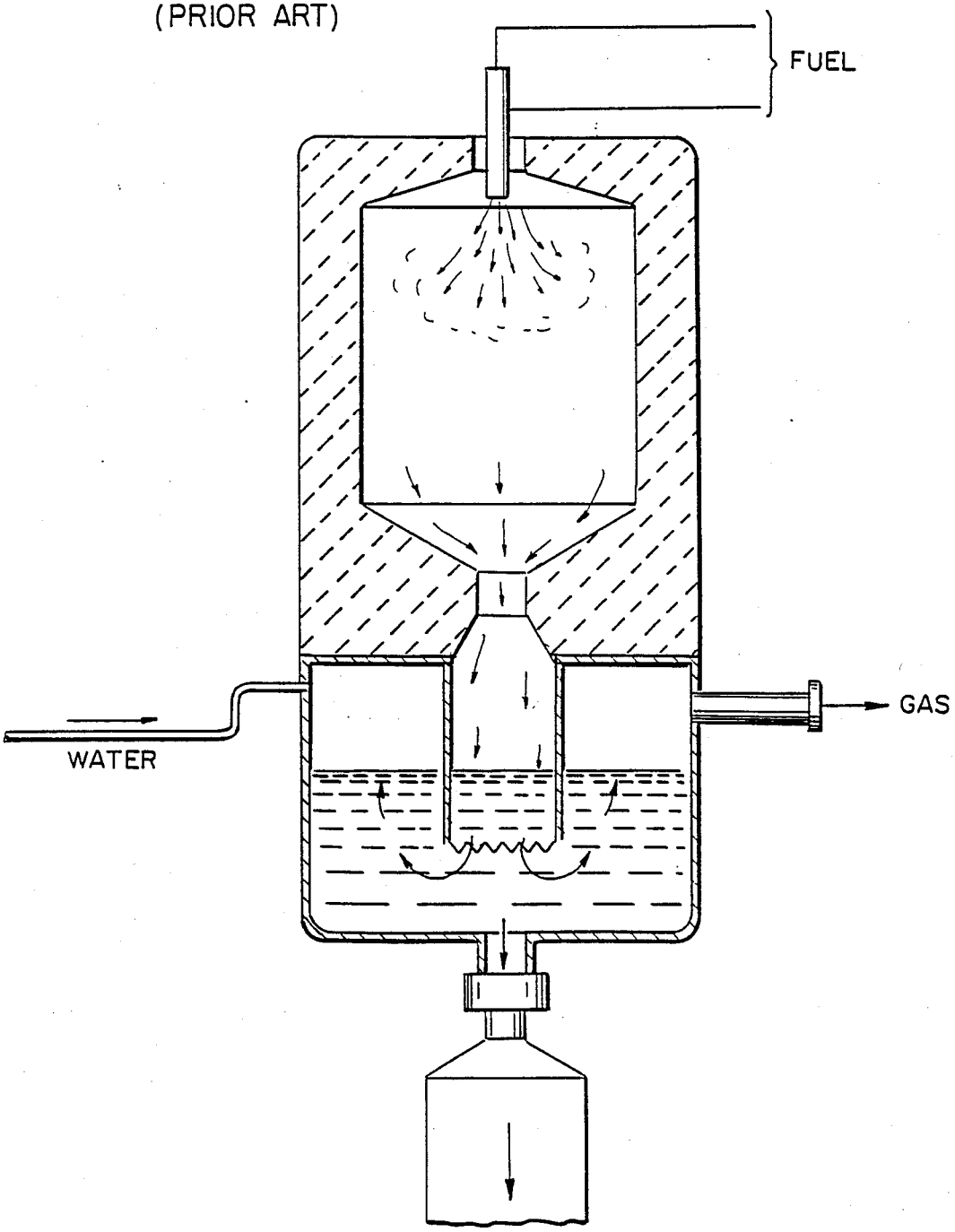
FIG. 1 (PRIOR ART)
FIG. 1 is a schematic cross-secgtional view of a prior art gasifier.
Figure 2:
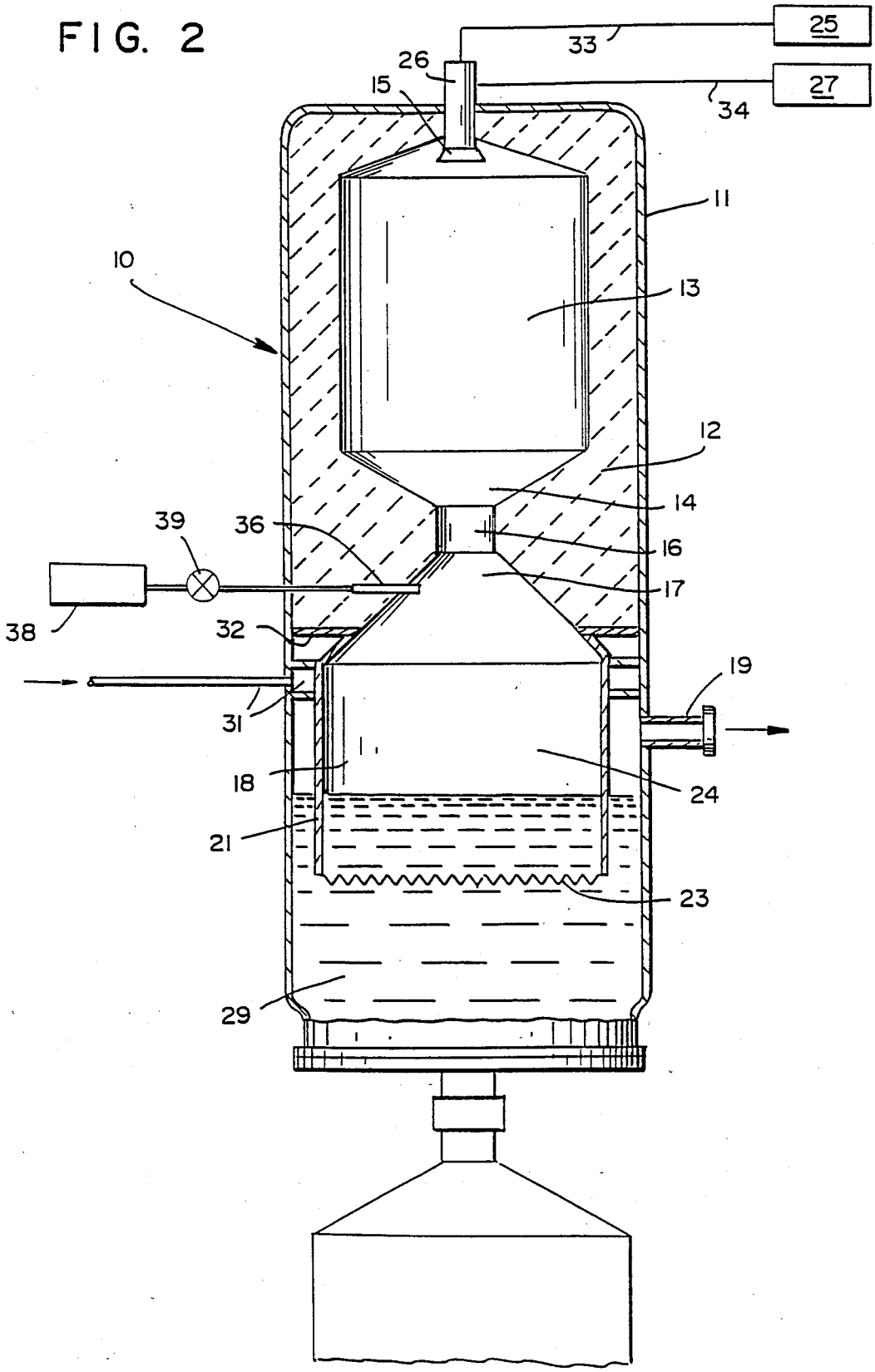
FIG. 2 is a cross-sectional elevation view of a gasifier disclosed herein.

Referring to FIG. 2, in one embodiment of a gasifier in which the present invention is incorporated, there is provided a reaction vessel or gasifier 10. The latter is comprised of a shell 11 having a refractory lining 12, and fuel access port 15. A combustion chamber 13 includes an outlet 14 which is constricted to a narrow throat section 16, which opens into a conical passage 17.

Passage 17 is communicated with a cooling or quench chamber 24 within a dip tube 21. The lower edge of dip tube 21 preferably includes a series of serrations 23, which extremity is immersed in the bath 29 formed of a quench liquid such as water. Quench chamber 24 includes an upper, first contact portion 18 having a gas discharge conduit 19 communicated therewith to direct cooled, synthetic or produced gas.

The upper wall of gasifier 10 is provided with a removable burner 26 which, although not shown in detail, is communicated through line 33 with a source 25 of the particulated fuel in slurry form. It is also communicated with a pressurized source 27 of the combustion supporting gas such as air or oxygen, by line 34.

Toward receiving both the gaseous product and the solid effluent resulting from the process, a quench ring 31 is provided under the floor 32 of the upper portion of reactor vessel 10 and communicated with a source of water. Quench ring 31 can include an upper surface which preferably bears against the lower side of floor 32. Quench ring 31 engages the upper end of dip tube 21 to deliver a flow of water against the latter. The inner exposed surface of quench ring 31 can thus be wetted to facilitate downward passage of solids and gas toward bath 29.

In accordance with one embodiment of the invention, passage 17 is in the general configuration of a frusto-conical member. The latter is provided with a relatively smooth wall, having the narrower upper end communicated with the discharge throat 16 of a combustion chamber 13. The outwardly divergent wall terminates at the upper end of quench chamber 24. Thus, hot, downwardly flowing gas and particulate matter, will be conducted under combustion chamber pressure into liquid bath 29.

As herein noted, cooled product gas will thereafter bubble to the surface of liquid bath 29 and be conducted for further processing through conduit 19 in the wall of gasifier shell 11 to further processing equipment.

Figure 3:
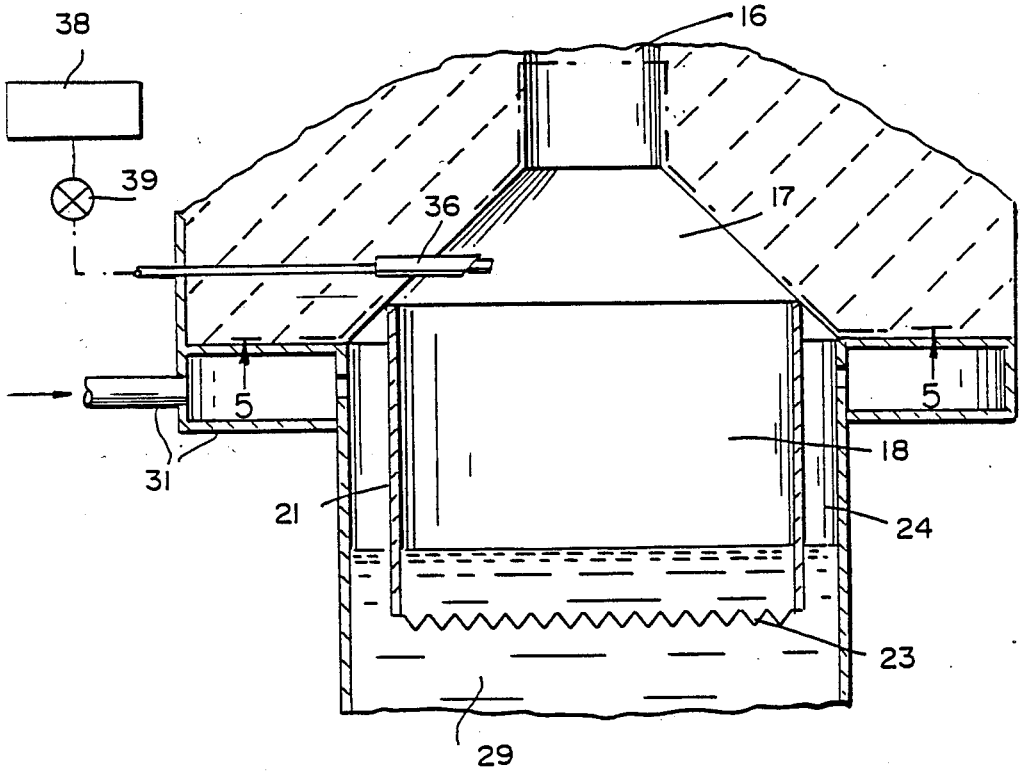
FIG. 3 is a segmentary view on an enlarged scale of a portion of the gasifier shown in FIG. 2.

Referring to FIG. 3, to provide the frusto-conical section 17 with a particle scouring or sweeping facility, this section is furnished with one, and preferably with a plurality of nozzles 36. The latter as shown, are communicated through a conductor 37 to a source of gas scouring gas 38.

The latter functions as vehicle for delivering one or more high velocity gas jets into the frusto-conical passage 17. The gas jets are arranged in a pattern to contact particulate matter, and especially vanadium containing particles which would tend to cool and freeze on the walls if not disposed of.

The dislodging or injected gas, is contained in source 38 at a pressure exceeding gasifier pressure, and preferably between about 6 and 251 atmospheres. The gas volume can be further communicated through conduit 37 by way of a control valve 39, with other nozzles which terminate at the wall of passage 17.

Figure 4:
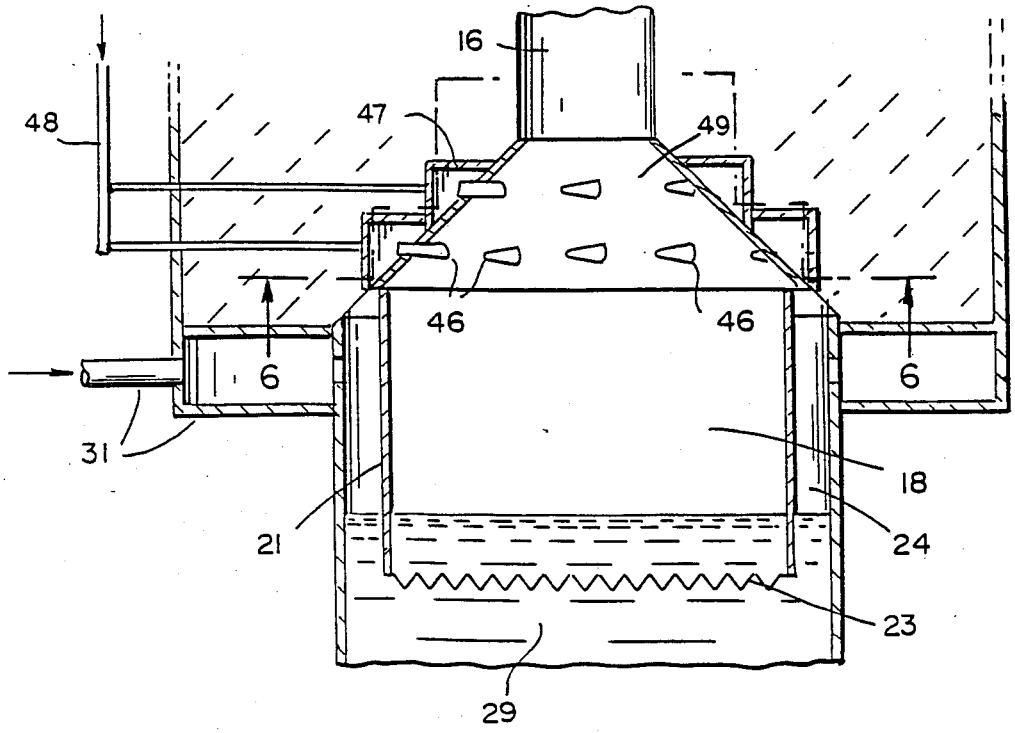
FIG. 4 is similar to FIG. 3.

As shown in FIG. 4, to facilitate introduction of a series of high velocity wall scouring jets into passage 17, the respective nozzles 46 are commonly communicated through a single manifold 47 to a pressurized gas source by a connecting line 48.

To achieve complete and efficient distribution of the dislodging gas along walls of passage 17, the latter is furnished with the necessary number of nozzles. As shown in FIG. 4, the respective nozzles 46 nozzles are arranged in a series of parallel layers, one above the other, and peripherally spaced to achieve maximum coverage.

While the dislodging of solid, particulate matter from the walls of the passage 17 can be achieved with a number of embodiments of high velocity jets, preferably the latter are directed substantially tangential to the passage 17 wall. Thus, when properly placed, the high velocity gas stream will tend to sweep or scour said wall clean of particulate matter.

Since the sweeping action of the dislodging gas need not be a continuous process, the high pressure source at 38, can be connected through control means which regulate flow control valve 39. Operationally, the dislodging gas stream or streams are activated and introduced only periodically into the frusto-conical passage 17. This periodic introduction can be achieved preferably through suitable electrically controlled valves which are in turn activated by a timer whereby to regulate the gas flow.

It is understood that although modifications and variations of the invention can be made without departing from the spirit and scope thereof, only such limitations should be imposed as are indicated in the appended claims.

We claim:

1. A gasifier (10) for combusting a particulated carbonaceous fuel mixture to produce a usable gas and residual solids, comprising:

a shell (11), means forming a combustion chamber (13) in said shell (11) in which said carbonaceous fuel mixture is combusted, injector means (26) connected to a supply means of a particulated fuel (25) and to a combustion supporting gas (27) to form said carbonaceous fuel mixture and to direct said mixture into the means forming said combustion chamber (13), means forming a quench chamber (24) in said shell holding a liquid bath (29) beneath the combustion chamber, means forming a throat (16) interconnecting said means forming said combustion chamber and said means forming said quench chamber, and having an outwardly divergent wall defining a passage (17) to conduct said usable gas and residual solids from the means forming said combustion chamber toward said liquid bath, nozzle means having nozzle discharge openings aligned contiguous with said outwardly divergent wall to direct pressurized streams of a scouring gas along said divergent wall to contact and dislodge residual solids which have become deposited thereon, said nozzle means including a plurality of discrete nozzles arranged in spaced apart layers along said outwardly divergent wall to direct said scouring gas, each of said spaced apart layers of nozzles having an individual manifold carrying said pressurized scouring gas.

2. A gasifier as defined in claim 1, wherein said spaced apart layers of nozzles are disposed in substantially parallel relationship with each other.

3. A gasifier as defined in claim 1, wherein said layers of nozzles are arranged in circumferential rows about the outwardly divergent wall of the means forming said throat.

* * * * *